United States Patent [19]

Monacelli

[11] 3,945,550

[45] Mar. 23, 1976

[54] STAPLE-FEEDING MAGAZINE FOR A STAPLER

[76] Inventor: Umberto Monacelli, Via Parini 6, Monza, Milan, Italy

[22] Filed: Nov. 12, 1974

[21] Appl. No.: 523,131

[30] Foreign Application Priority Data

Nov. 12, 1973 Italy ..... 31219/73

[52] U.S. Cl. ..... 227/126

[51] Int. Cl.[2] ..... B25C 5/16

[58] Field of Search ..... 227/108, 109, 120, 125, 227/126

[56] References Cited

UNITED STATES PATENTS

| | | | |
|---|---|---|---|
| 2,006,054 | 6/1935 | Maynard | 227/126 |
| 2,097,051 | 10/1937 | Stock | 227/125 |
| 2,770,804 | 11/1956 | Schafroth | 227/108 |
| 2,899,679 | 8/1959 | Allen | 227/108 |
| 2,999,241 | 9/1961 | Starr | 227/126 |
| 3,005,988 | 10/1961 | Kirton | 227/120 X |

*Primary Examiner*—Granville Y. Custer, Jr.
*Attorney, Agent, or Firm*—Shlesinger, Fitzsimmons & Shlesinger

[57] ABSTRACT

There is disclosed a staple-feeding magazine for a stapler of the kind comprising a driving channel, a staple driver having work and return strokes within the driving channel and a staple-feeding magazine connected to the driving channel. In order to allow the rear-loading of the staples without involving any bulk problem, the magazine has the baseplate rearwardly extending with respect to the open rear end of the staple guiding channel so as to define a projecting end portion on which anchoring means for the pusher are provided. The anchoring means are made and arranged so that the pusher, when anchored thereto, is still within the overall space of the magazine but in a depressed position at which the rear end of the guiding channel is left clear for staple loading purposes.

12 Claims, 10 Drawing Figures

VII
VII
3
4
12
13
14
15
16
17
18
26
27
28
30
31
32
33
34
35
36
37
50

STAPLE-FEEDING MAGAZINE FOR A STAPLER

This invention relates to a staple-feeding magazine for a stapler which uses metal staples.

It is known that the staplers which use metal staples (the term "metal staples" being intended herein as to indicate also staples of another material but having the usual U-shaped outline) essentially comprise a driving channel, a driver for driving and ejecting the metal staples, mechanical or pneumatical means for controlling the reciprocal motion of the work or active and return strokes of the driver in the driving channel and a staple feeding magazine which is connected to the driving channel so as to feed thereto in a transversal direction and in orderly sequence a succession or bar of metal staples.

It is likewise known that the feeding magazine for the metal staples basically comprises, as affixed to a baseplate, a guiding and supporting channel for the metal staples as arranged in succession, which has an inverted-U shaped in cross-section with at least a front end open and communicating with the driving channel for orderly delivering the staples to the driving channel. The connection between the magazine and the driving channel is obtained by means of a plate, which is formed as an entity with the baseplate and the magazine guiding channel and has a hole formed therethrough, whose shape, size and position are such as actually to be an extension of the open end of the guiding channel. This plate is introduced into a corresponding lateral opening of the driving channel and is locked therein so as actually to provide a portion of one of the sidewalls of the driving channel which provide to guide the staples in the driving channel aforesaid. Within the magazine guiding channel, but behind the succession of staples as inserted in the guiding channel, there is slidably housed a follower or pusher having substantially an inverted-U shape in cross-section, the pusher being resiliently biased towards the aforesaid open end of the guiding channel, so as to impress to the staple bar a continuous thrust to have it urged forwards towards the driving channel.

One of the problems which prevailingly concern the manufacturers of staplers and cause discordance among them is that of the procedure as used for loading the staples. It is obvious, in point of fact, that, to be able to effect a "rear loading" of the staples, that is, to load them through the rear end, which in this case is also open, of the guiding channel, this being doubtless the preferred approach, it is first necessary to remove the pusher for the guiding channel so as not to create an obstacle to the introduction of the staples. To do so, however, it is required that an appropriate anchoring position be provided to retain the pusher under such conditions as to clear the access to the rear end of the guiding channel against the bias of the resilient means which urge the pusher towards its working position. The anchoring of the pusher in such a position as to clear the access to the guiding channel usually originates bulk problems, in the sense that the approaches as adopted heretofore have proven to be either intricate or poorly functional, or they have originated an unduly high increase of the overall bulk of the machine, or, moreover, they have required the temporary withdrawal of the pusher from the magazine space.

An object of the present invention is thus to provide a magazine for a stapler, in which the problem of the staple loading through the open rear end of the guiding channel is solved in a simple, functional way which is such as not to involve any problems as to the increase of the bulk, even as a temporary measure.

According to the invention, this object is achieved by means of a magazine which is characterized in that the follower has an inverted-U cross-sectional shape of such a size that the distance between the outer surfaces of its vertical walls is less than the distance between the inner surfaces of the legs of the staples to be fed in, and that the open rear end of the guiding channel is in an advanced position relative to the corresponding end of the baseplate so as to define a projecting end portion of the plate on which an anchoring means is provided which can releasably engage a complementary anchoring means with which the follower is provided, said anchoring means being so made and arranged that the follower, whenever it is withdrawn from the guiding channel and anchored to said end position of the baseplate owing to the mutual engagement of the anchoring means, is still within the overall space of the magazine but in a depressed position which allows the horizontal wall of the magazine to leave clear the access to the rear end of the guiding channel for introducing a staple bar into said channel.

It is obvious that such an approach does not originate any bulk problems, since the follower always remains within the usual magazine bulk boundaries. On the other hand, when the follower is withdrawn from the guiding channel and depressed and anchored, as outlined above, to the baseplate, the access to the rear end of the guiding channel is left wholly clear and a new staple succession or bar can conveniently be introduced from behind into the channel, by, so to speak, straddling the lowered follower. As can be seen, this is thus a simple and functional solution to the problem of the rear-loading of the magazine.

The two complementary anchoring means, whose mutual engagement permits anchoring the follower to the end position of the baseplate in the appropriate depressed position after having withdrawn the follower from the guiding channel, can be obtained in several ways. According to a preferred embodiment of the magazine according to the invention, one of the two anchoring means is formed by a pin, or another upright member affixed to the above mentioned end portion of the baseplate, which is extended upwardly to a height which is below the horizontal portion of the guiding channel and, which has therein rearwardly of the guiding channel, at least one notch which can engage the follower or pusher, as the latter is withdrawn from the guiding channel, anchoring the pusher to maintain same in the above indicated depressed position where the access to the rear end of the guiding channel is made clear to load the staple bar. In its turn, the other anchoring member is preferably the rear edge of an opening in the horizontal wall of the pusher, the pin aforesaid being capable of entering said opening and sliding therein when the pusher is displaced towards said lowered position upon having been withdrawn from the guiding channel. Still preferably, the above mentioned pin is also equipped, on the same surface as before, with a second notch placed at a higher level than the first, in which the same rear edge of the pusher opening can be both engaged and anchored in the case of an accidental release of the rear edge, and thus of the pusher, from the first named notch. The second notch is thus an efficient safety means against accidental and hazardous forward snaps of the pusher.

Another feature which is not of vital significance but is nevertheless preferred for the magazine according to the invention is the fact that the bottom ends of the vertical walls of the pusher have outwardly curled tabs which engage the prongs of the last staple of a staple bar to supplement the thrust imparted to the staple head. Thus a better balanced overall thrust is produced, which is such as to prevent possible jams of staples within the guiding channel.

Still another feature which preferably characterizes the magazine according to the invention is the fact that the guiding channel is so shaped as indifferently to allow for the use of metal staples having two different widths. This is due to the fact that the guiding channel is defined between two coaxial longitudinal structures as arranged the one inside the other, both having a U-shaped cross-section but with the internal structure having vertical walls with the top portions placed closer to one another than the bottom ones. The result is that the possibility is afforded both of using wider staples, whose legs are guided by the vertical walls of the external structure, and of using narrower staples, whose legs are guided by the more widely spaced apart bottom portions of the vertical walls of the internal structure. The vertical walls of the pusher, in their turn, are guided by the less closely spaced apart portion of the inner structure while, concurrently, the curled end tabs of the vertical walls of the pusher find their space in those symmetrical portions of the guiding channel which are defined between the vertical walls of the external structure and the top portions of the vertical walls of the internal structure.

Another problem as encountered in the construction of feeding magazines for staplers is the plate which, as outlined above, is arranged in correspondence with the magazine front end and is intended to provide a portion of either sidewall of the driving channel. Upon considering the guiding functions entrusted to the plate and thus the intense wear stresses it must undergo (also due to the considerable speed at which, especially in the pneumatically actuated stapling machines, the staples travel in the driving channel), this plate should be made of hardened steel or another material having a high resistance to wear, and, therewith the entire magazine or at least the baseplate should be made to make up a single piece. The result is, obviously, a high first cost of the magazine.

According to the invention, this problem is solved, instead, by making the plate as a discrete unit with respect to the remainder of the magazine, to which it will be fastened subsequently in the course of the assembly stage.

By so doing, the plate only needs to be made of a very expensive special material, while the remainder of the magazine can be made of a more usual, and thus less costly, material as desirable.

The foregoing and other features of the present invention will be better understood from the ensuring detailed description of a metallic staple machine having a magazine made according to the invention. In the detailed description reference will be had to the accompanying drawings, wherein.

Figure 1:
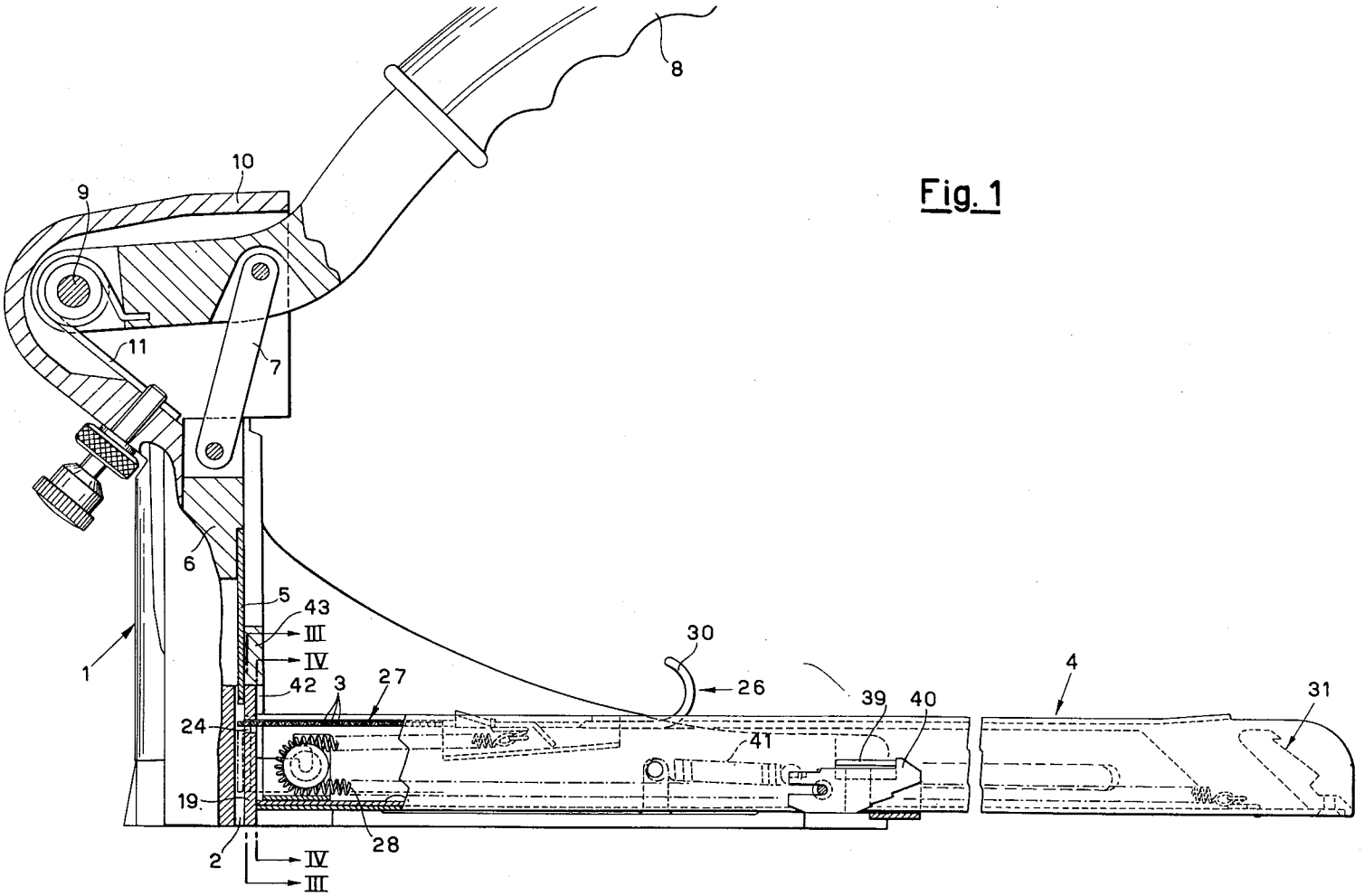
FIG. 1 is an elevational view, partly in section, of the entire metal-staple stapling machine.

The metal tack stapler as shown in the drawings comprises a header piece 1, within which a driving channel 2 is defined for metal staples 3 which are sequentially and individually fed from a magazine or loader 4.

In the driving channel 2 there is slidably mounted a driver or striker 5 which is affixed to a block 6: the latter, in its turn, slides in a guiding channel of its own. The block 6 is connected by the agency of a link 7 to an actuating lever 8, which is pivoted at 9 to the outer casing 10 of the header piece 1 and is urged towards its at rest position as shown in FIG. 1 by a spring 11.

Figure 7:
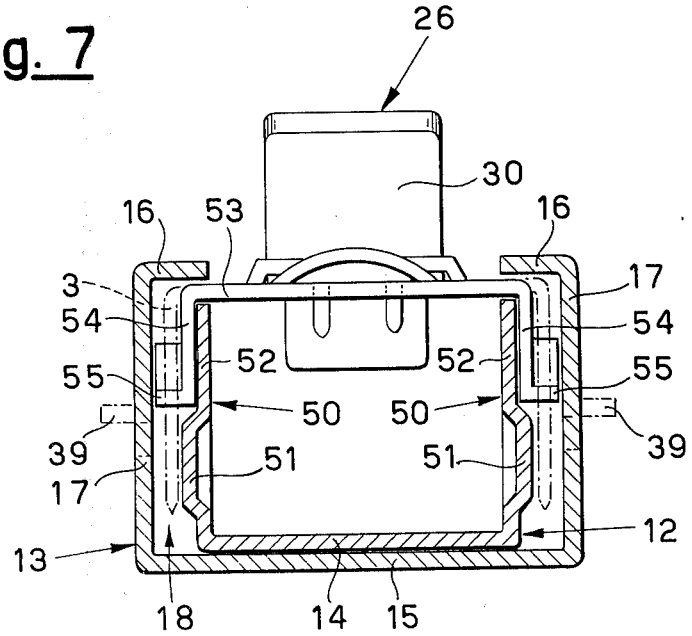
FIG. 7 is a cross-sectional view, taken along the line VII—VII of FIG. 6.

The magazine 4 is formed by two elongate structures or frames 12 and 13 which are arranged parallel and one inside the other, and which are mutually fastened in correspondence with their respective baseplates 14 and 15. As can be seen in FIG. 7, the inner frame 12 has substantially a U-shaped cross-section as formed by the baseplate 14 and two upright sidewalls 50 equipped with more widely spaced apart bottom portions 51 and with more closely spaced apart top portions 52. In its turn, the outer frame 13 has a U-shaped cross-section as provided by the baseplate 15 and two sidewalls 17 equipped with top end curls or flanges 16.

Between the two frames 12 and 13 a longitudinal guiding channel 18 is defined, having a cross-section somewhat in the form of an inverted U, which is open at both ends and in which there can be housed for sliding movement staple bars 27, each comprising a plurality of staples 3 arranged to be fed one by one to the driving channel 2. More exactly, the guiding channel 18 can house metal staple bars of two different sizes, that is, either staple bars with narrower staples, whose legs are guided by the bottom portions 51 (more widely spaced apart) of the sidewalls of the inner frame 12 (a case shown in the drawings and more particularly in FIGS. 4, 7 and 9), or wider staple bars whose legs are guided by the sidewalls of the outer frame 13.

Figure 3:
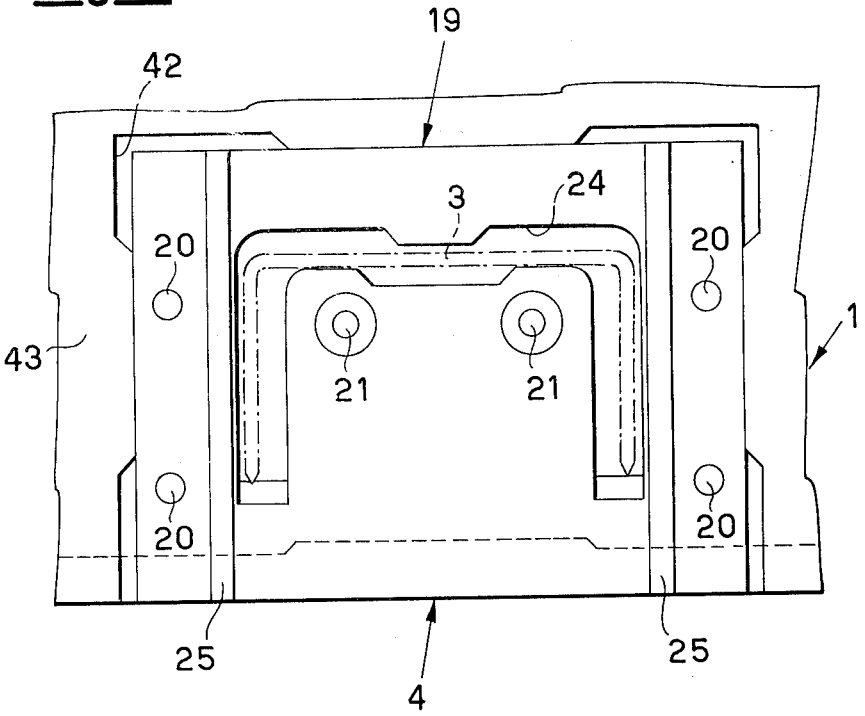
FIG. 3 is a cross-sectional view taken along the line III—III of FIG. 1.
Figure 4:
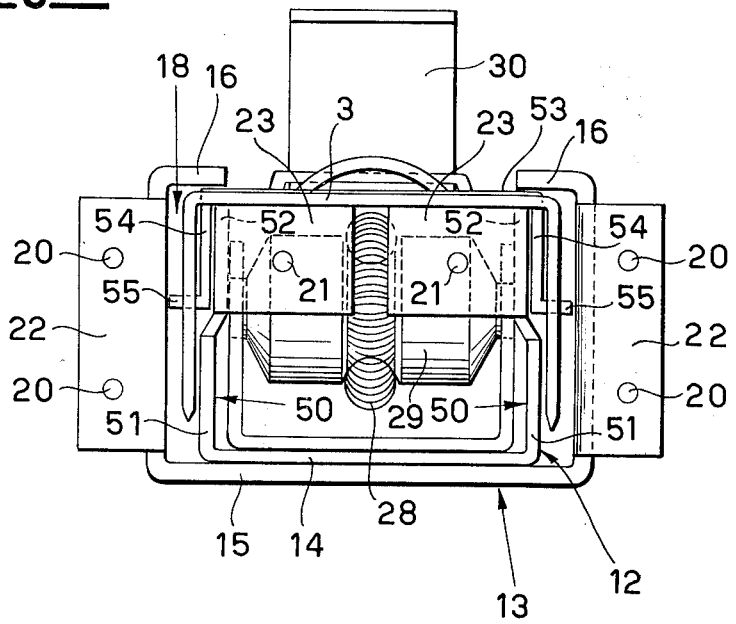
FIG. 4 is a cross-sectional view taken along the line IV—IV of FIG. 1.

In correspondence with the front end of the guiding channel 18 there is arranged a plate of hardened steel 19 (FIGS. 2 and 3) which is affixed to the remaining part of the magazine by bolts 20 and 21 engaged in the plate 19 and in external flanges 22 and internal flanges 23 of the two frames 13 and 12 (FIG. 4). Through the plate 19 an inverted-U hole 24 is formed, which exactly mates the front end opening of the guiding channel 18 and actually is an extension thereof. Lastly, the plate 19 has two vertical and parallel ribs 25.

Within the guiding channel 18 and behind the metal staple bar 27, there is slidably inserted a follower or pusher 26, which has substantially the shape of an inverted-U in cross-section, and which is formed by a horizontal wall 53 slidably housed in the horizontal portion of the guiding channel 18, and by two vertical walls 54 housed to slide in the vertical parts of the guiding channel 18 above the bottom portions 51 of the sidewalls 50 of the inner frame 12. The distance between the outer surfaces of the vertical walls 54 of the pusher 26 is less than the distance between the outer surfaces of the bottom portions 51 of the sidewalls of the frame 12, and thus less than the distance between the inner surfaces of the legs of the staples, irrespective of the size of the latter (FIGS. 4 and 7). To allow the pusher to act upon the staple legs and upon the staple head too, the bottom ends of the vertical walls 54 have tabs 55, curled outwardly, which are housed adjacent the upper ends of the vertical portions of the channel 18.

Figures 5, 6:
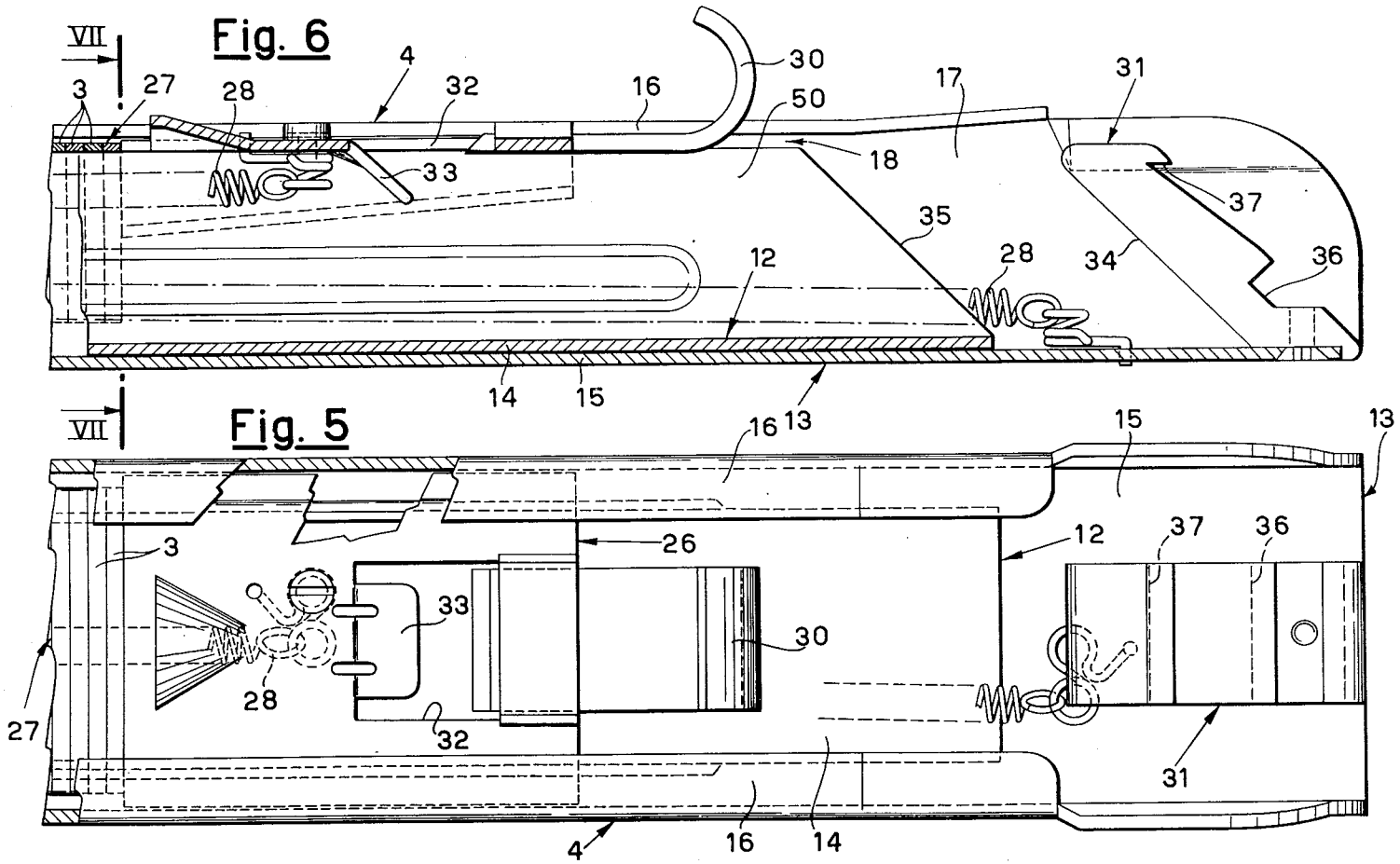
FIG. 5 is a plan view, partly in section, which shows the rear portion of the magazine contained in the machine of FIG. 1, the metallic staple pusher being shown herein in a position which is well behind the position of FIG. 1.
FIG. 6 is a longitudinal cross-sectional view of the portion of magazine shown in FIG. 5.

The pusher 26 is pulled towards the open front end of the guiding channel 18 and thus towards the last metal staple of a staple bar by a spring 28 wrapped around an idle roll 29 (FIG. 2) and having either end affixed to the pusher 26 (FIG. 1), the other end being affixed to the baseplate 15 of the outer frame 13 (FIG. 6).

Figure 9:
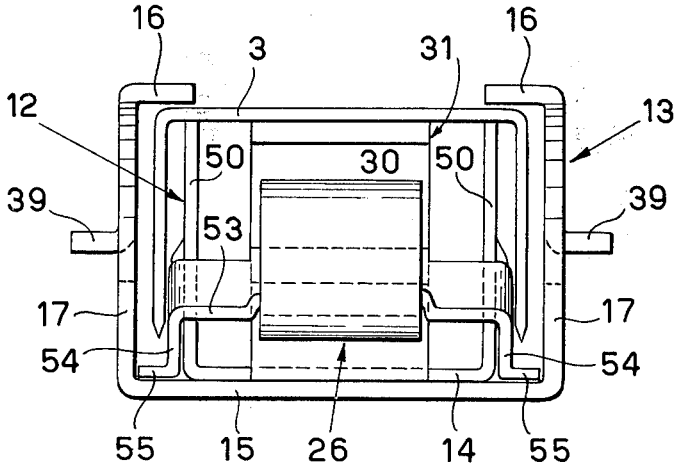
FIG. 9 is an elevational view from the back, which shows how the arrangement of the pusher according to FIG. 8 makes clear the access to the guiding channel for the magazine in order to effect the loading of a metal staple bar.
Figure 10:
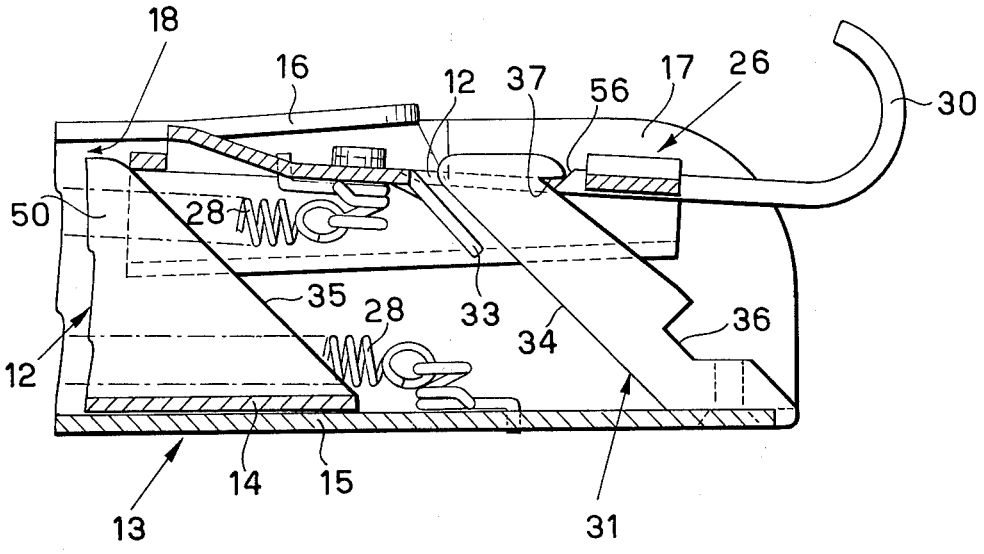
FIG. 10 is a cross-sectional view similar to FIG. 8 but with the pusher in a different anchoring position outside the guiding channel.
Figure 8:
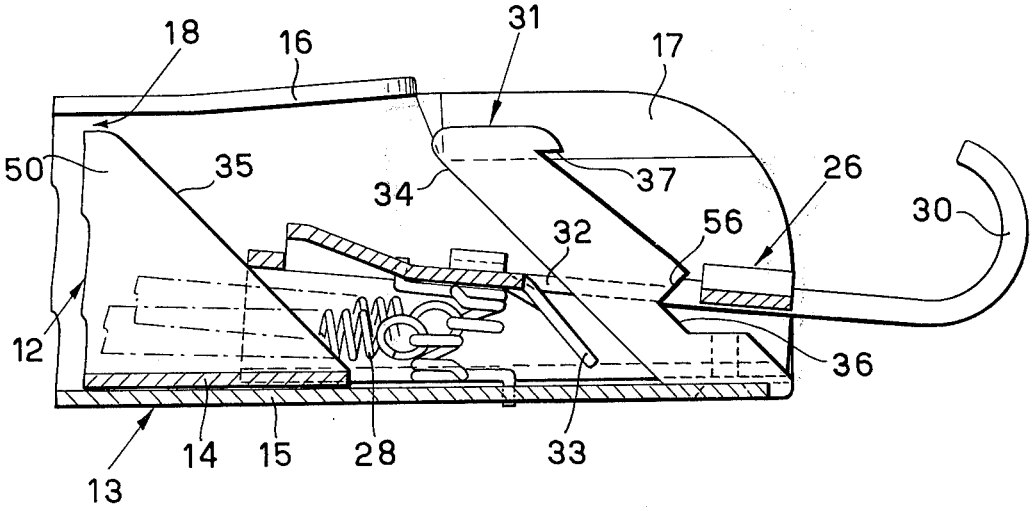
FIG. 8 is a longitudinal cross-sectional view showing the pusher as anchored in a position which is adapted to load a staple bar.

The pusher 26 has also a hooked rear extension 30, by whose agency it is possible to overcome the bias of the spring 28 and to withdraw the pusher from the guiding channel 18 through the rear end opening thereof. Once it has been removed from its guiding channel, the pusher 26 can be anchored in such a position as to clear the access to the rear end of the channel in order to load a metal staple bar again. To this purpose, an upright pin 31 is provided, which is affixed to the baseplate 15 of the outer frame 13 (as extended rearwards relative to the inner frame 12) and is extended upwards to a level which is below the horizontal portion of the rear end of the guiding channel 18 (FIGS. 6, 8 and 10). This pin can engage the pusher 26, the latter being equipped to this purpose with a central opening 32. The sliding of the pusher 26 along the pin 31 is both guided and encouraged by the engagement between a sloping tongue 33 of the pusher and the front wall, also sloping, 34, of the pin 31. An additional possibility of engagement is the slope of the rear end 35 of the internal frame 12. To anchor the pusher, the rear surface of the pin 31 has a notch 36 which, as can be seen in FIGS. 8 and 9, is positioned in such a way as to keep the pusher 26 outside the route along which the metal staple bars should go to be fed into the guiding channel 18. An additional notch 37 in the rear of pin 31 has a safety function, in the sense of anyhow locking the pusher 26 in the case of disengagement from the notch 36 (FIG. 10). The notches 36 and 37 are intended to engage the rear boundary edge 56 of the pusher opening 32.

Figure 2:
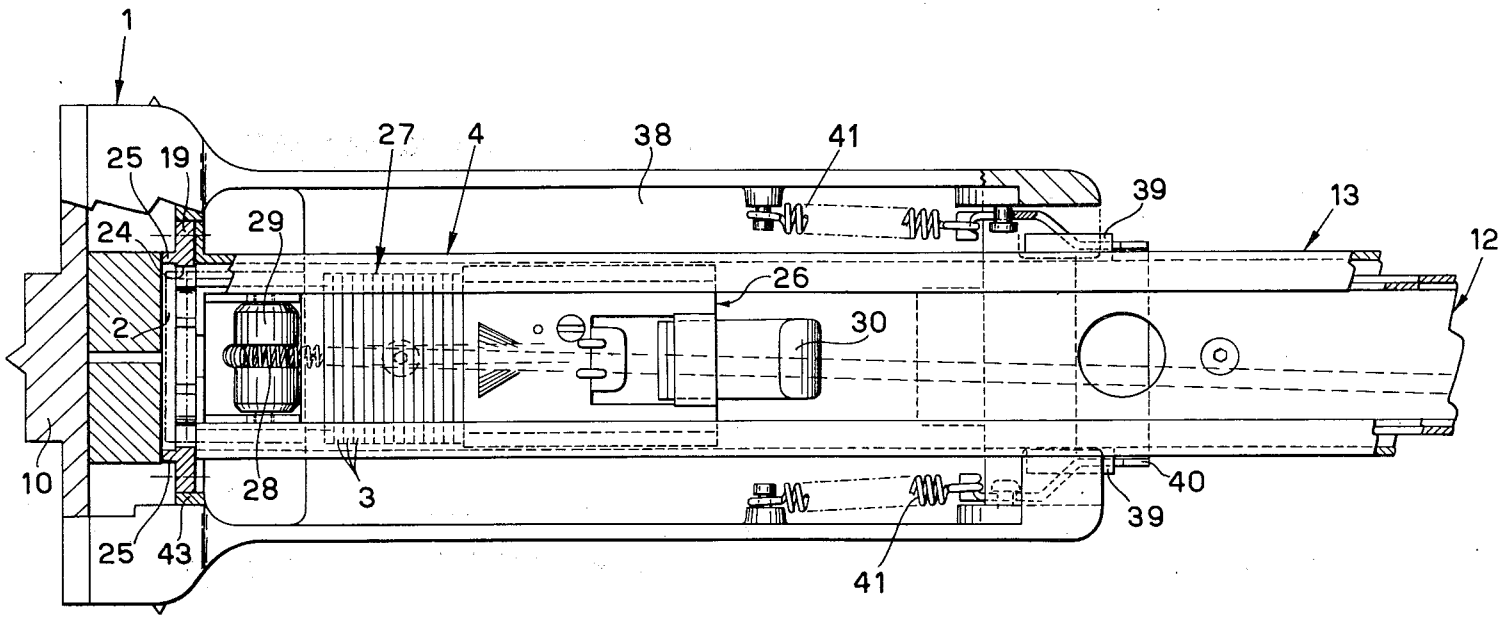
FIG. 2 is a plan view, partly in section, which shows in more detail the mode of connection between the magazine and the remaining portion of the stapler of FIG. 1.

To support the magazine 4, there is provided, lastly, an elongate bracket 38, having a U-shaped cross-section, which projects from the outer casing of the stapler header piece. In use the magazine is inserted into said elongate bracket and locked in a resiliently yieldable manner through the engagement of two side tabs 39 of the outer frame 13 with a bridge 40 which is pivoted to the bracket 38 and resiliently biased by springs 41 (FIG. 2).

With the magazine in position (FIG. 1), the plate 19 is inserted in a lateral opening 42 of the driving channel 2 and is virtually a completion of the corresponding wall 43 of the driving channel.

From the foregoing and a careful scrutiny of the drawings, the operation of the stapler as shown is obvious. The pusher 26, and more exactly its horizontal wall 53 and its curled tabs 55, thrusts, one at a time, the individual metal staples into the driving channel 2, where, at every actuation of the lever 8, they are engaged, still individually, by the driver 5 and ejected out of the driving channel.

When, as a first staple bar has been exhausted, it is desired to introduce a fresh metal staple bar in the guiding channel 18, the hooked extension 30 of the pusher 26 is pulled so as to remove the pusher from the guiding channel. Then, the engagement is caused to occur between the opening 32 of the pusher and the fixed pin 31 and, by exploiting the engagement aids as formed by the sloping planes 33, 34 and 35, the pusher is urged downwards until anchoring it to the notch 36 of the pin 31. Inasmuch as the access to the rear end opening of the guiding channel 18 has become clear (FIGS. 8 and 9), it is possible to load a fresh metal staple bar, by having it, so to speak, straddling the lowered pusher (FIG. 9) and by exploiting the guiding action as provided by the vertical walls 17 and the end curls 16 of the outer frame 13 as well as by the sloping plane 35 of the inner frame 12. Should the pusher become accidentally clear of the notch 36, it would equally be retained by the notch 37, that which would prevent a dangerous abrupt snap thereof towards the machine head. As the reloading has been carried out, the pusher is obviously disengaged from the pin 31 and introduced in the guiding channel 18 again.

What I claim is:

1. A staple-feeding magazine for a stapler of the kind comprising a driving channel, a staple-ejecting driver, means for controlling a reciprocation of active and return strokes of the driver within the driving channel, and a feeding magazine connected to the driving channel so as to feed a succession of metallic staples individually one after the other to said driving channel, said magazine also comprising a baseplate, means defining an elongate guiding channel intended to support and to guide a succession of staples, said guiding channel being formed on said baseplate and being open at both ends to form staple loading and feeding ends, respectively, and to progressively guide said staples to the driving channel, a follower mounted for sliding movement in said guiding channel behind said succession of staples and resiliently urged towards said feeding end of the guiding channel so as to impart to said succession of staples a continuous thrust towards said feeding end, said follower being withdrawable from said guiding channel through said loading end thereof, and having generally an inverted-U cross-sectional shape of such a size that the distance between the outer surfaces of its parallel side walls is less than the distance between the inner surfaces of the staple legs, the open, rear, staple loading end of the guiding channel being in an advanced position relative to the corresponding rear end of the baseplate so that an end portion of said baseplate projects rearwardly beyond said guiding channel, and cooperating anchoring means provided on said follower and on said end portion of said baseplate, respectively, and releasably engageable, when said follower is removed from the guiding channel, to anchor said follower to said end portion of the baseplate in a position in which said follower remains within the overall contour of the magazine and above said baseplate and said end portion thereof, but in a lowered position which allows its transverse wall portion between said side walls thereof to leave clear said rear end of the guiding channel to permit insertion of a succession of staples in the guiding channel, one of said anchoring means comprising an upright member affixed to said end portion of the baseplate and extending upwardly therefrom to a height beneath the horizontal portion of the guiding channel and having in its rear end at least one notch which is engageable with the anchoring means on said follower, when the follower is removed from its guiding channel, to anchor said follower in said lowered position.

2. A magazine according to claim 1, wherein said upright member has in its rear end a second anchoring notch arranged at a higher level than the first-named notch.

3. A magazine according to claim 1, wherein said upright member is inclined towards the rear end of the guiding channel.

4. A magazine according to claim 1, wherein the anchoring means on said follower comprises the rear edge of an opening formed through the transverse wall of the follower and through which opening said upright member can be introduced to engage the rear edge of said opening in the notch in said upright member as the follower is displaced towards said lowered position after having been removed from the guiding channel.

5. A magazine according to claim 1, wherein the side walls of the follower have outwardly curled tabs which are adapted to impart a thrust action against the legs of the staples to be fed in.

6. A magazine according to claim 1, wherein said guiding channel is defined between two coaxial longitudinal structures arranged one inside the other, each of said structures having a substantially U-shaped cross-section, with the outer structure equipped with sidewalls spaced from the sidewalls of the inner structure, and curled inwardly at their upper ends so as to define an inverted-U cross-sectional space for said guiding channel.

7. A magazine according to claim 6, wherein the bottom wall of the outer structure is the magazine baseplate.

8. A magazine according to claim 6, wherein the sidewalls of the outer structure are extended to the rear end of the baseplate.

9. A magazine according to claim 7, wherein the rear end of the internal structure is spaced forwardly from the rear end of the baseplate and is inclined to extend parallel to said upright member.

10. A magazine according to claim 7, wherein the outer structure has spaced vertical sidewalls, and the inner structure has spaced sidewalls portions of which adjacent the lower ends thereof, are spaced wider apart from each other than the upper portions of the last-named sidewalls.

11. A magazine according to claim 11, wherein the sidewalls and the curled tabs of the follower are slidably housed in the upper portions of the guiding channel as defined by the spaces between the sidewalls of the outer structure and the upper portions of the sidewalls of the inner structure.

12. A magazine according to claim 1, comprising a plate arranged in correspondence with the feeding end of the guiding channel and equipped with a hole adapted to be an extension of said guiding channel, said plate being mounted in a lateral opening of the driving channel of the stapling machine and being made as a piece separate from the remaining part of the magazine, and being fastened to the latter by fastening means.

* * * * *